US006564459B1

(12) United States Patent
Steinbrueck et al.

(10) Patent No.: US 6,564,459 B1
(45) Date of Patent: May 20, 2003

(54) CHAIN SAW

(75) Inventors: Egbert Steinbrueck, Sebnitz (DE); Juergen Dolata, Sebnitz (DE)

(73) Assignee: Robert Bosch GmbH, Stuttgart (DE)

( * ) Notice: Subject to any disclaimer, the term of this patent is extended or adjusted under 35 U.S.C. 154(b) by 114 days.

(21) Appl. No.: 09/786,540

(22) PCT Filed: Jun. 9, 2000

(86) PCT No.: PCT/DE00/01924

§ 371 (c)(1),
(2), (4) Date: Mar. 5, 2001

(87) PCT Pub. No.: WO01/03896

PCT Pub. Date: Jan. 18, 2001

(30) Foreign Application Priority Data

Jul. 7, 1999 (DE) ..... 198 31 250

(51) Int. Cl.[7] ..... B27B 17/02; B27B 17/14

(52) U.S. Cl. ..... 30/383; 30/385; 30/386; 30/381; 30/392; 30/369; 30/375; 83/816; 83/778

(58) Field of Search ..... 83/375, 378, 386, 83/385, 830, 816, 817; 292/333

(56) References Cited

U.S. PATENT DOCUMENTS

| | | | | | |
|---|---|---|---|---|---|
| 3,636,995 | A | * | 1/1972 | Newman | 30/386 |
| 3,839,795 | A | * | 10/1974 | Dooley | 192/103 C |
| 3,866,320 | A | * | 2/1975 | Progl | 30/386 |
| 3,962,929 | A | * | 6/1976 | Silvon | 474/152 |
| 4,129,943 | A | * | 12/1978 | Bricker | 30/386 |
| 4,316,327 | A | * | 2/1982 | Scott et al. | 30/386 |
| 4,355,551 | A | * | 10/1982 | Kolleas | 76/78.1 |
| 4,382,334 | A | * | 5/1983 | Reynolds | 144/73 |
| 4,567,658 | A | * | 2/1986 | Wissmann et al. | 30/386 |
| 4,615,117 | A | * | 10/1986 | Flath | 30/122 |
| 4,835,868 | A | * | 6/1989 | Nagashima | 30/386 |
| 5,070,618 | A | * | 12/1991 | Edlund | 30/385 |
| 5,144,751 | A | * | 9/1992 | Weber | 30/383 |
| 5,174,029 | A | * | 12/1992 | Talberg | 30/385 |
| 5,184,403 | A | * | 2/1993 | Schliemann | 30/123.4 |
| 5,345,686 | A | * | 9/1994 | Zimmermann | 30/383 |
| 5,491,899 | A | * | 2/1996 | Schliemann et al. | 30/386 |
| 5,896,670 | A | * | 4/1999 | Gibson et al. | 30/386 |
| 5,938,508 | A | * | 8/1999 | Canella et al. | 451/54 |

FOREIGN PATENT DOCUMENTS

| | | |
|---|---|---|
| DE | 21 32 747 A | 2/1972 |
| DE | 93 11 081 | 11/1994 |
| WO | 98/33631 | 8/1998 |

* cited by examiner

*Primary Examiner*—Allan N. Shoap
*Assistant Examiner*—Phong Nguyen
(74) *Attorney, Agent, or Firm*—Michael J. Striker

(57) ABSTRACT

In a chain saw having a sprocket (11), which is supported in rotary fashion in a housing (10) and is for a saw chain (12) guided on a guide (13), and having a chain tension device (14) for longitudinally moving the blade (13), which device has a cam (15) that moves the guide (13) and a rotating member (17) for rotating the cam (15), in order to preset a chain tension that is optimal for operation and is independent of the user, the rotary connection between the rotating member (17) and cam (15) is embodied as a detent overload clutch (18), whose detent overload force is set in accordance with the required chain tension (FIG. 2).

10 Claims, 5 Drawing Sheets

CHAIN SAW

BACKGROUND OF THE INVENTION

The invention relates to a chain saw.

In a known chain saw of this type (DE 21 32 747 A1), a torsion spring is disposed between the rotating member and the cam, and this torsion spring drives the cam resting against the stop in a rotation direction such that the guide is constantly subjected to a longitudinal displacing force which strives to increase the guide's distance from the sprocket so that the saw chain is subjected to a constant tension force which compensates for a progressive lengthening of the saw chain due to abrasion and temperature increase during operation. During assembly, the torsion spring is stretched by means of the rotating member embodied as a turning knob until the cam rests against the stop with a sufficient degree of initial stress.

In a likewise known chain saw with a chain tension device (WO 98/33631 A1), the guide that guides the saw chain is fastened between two securing plates and is secured together with them to the housing so that it can be moved in the longitudinal direction of the blade. A bolt that passes through a bore in a cam and an oblong hole in the housing is screwed into the one securing plate, which is guided in a longitudinally movable fashion on the housing, and fixes the cam to the housing by means of its bolt head. In order to stretch the chain tight, the bolt is loosened slightly and the cam, which is supported with its circumference against a housing stop, is rotated so that the bolt moves with the securing plates in the direction of the free end of the blade. The rotation of the cam is stopped when it is evident by feel that the saw chain has reached a sufficiently high tension. The bolt is then tightened again so that the cam and the securing plates are fixed to the housing, with the guide in the adjusted position.

SUMMARY OF THE INVENTION

The chain saw according to the invention has the advantage that the detent overload clutch always sets a chain tension that is present at the factory and is independent of the user, and consequently, the user is not presented with the problem of whether the chain tension that he adjusts by feel is also the correct chain tension for an optimal operation of the chain saw. The chain tension device can thus be operated manually without tools which is why it requires only a rotating movement and no other axial movements of the blade whatsoever. An automatic loosening of the chain tension device resulting in decreasing chain tension during operation of the chain saw can be reliably prevented by means of a simple additional measure.

According to an advantageous embodiment of the invention, the cam is supported on the rotating member in a rotating, but axially fixed manner and the detent overload clutch has a first clutch disk provided with detent elements and non-rotatably fixed to the cam and a second clutch disk provided with detent elements and non-rotatably fixed to the rotating member as well as a prestressed clutch spring which presses the two clutch disks axially against each other, with their detent elements engaging one another. With this structural embodiment, the detent coupling is realized in a technically very simple manner and the detent overload force and thus the chain tension can be set by means of the clutch spring that is embodied as a compression spring.

According to a preferred embodiment of the invention, the rotating member is embodied as a clamping sleeve which is screwed with an internally threaded section onto an externally threaded section of a stay rod secured in the housing. In order to actuate the clamping sleeve, a turning knob is slid onto it in a nonrotating, preferably form-fitting manner. This structural embodiment achieves a simple operation of the chain tension device by means of a turning knob.

According to an advantageous embodiment of the invention, the stay rod protrudes through an oblong hole embodied in the guide, while the clamping sleeve overlaps the oblong hole and by being screwed onto the stay rod, pressed against the guide so that it is immovably fixed to the housing after the chain saw is stretched tight. As a result, the set chain tension is reliably maintained during operation of the chain saw.

According to an advantageous embodiment of the invention, the sprocket and the chain tension device are covered by a protective hood which is attached to the housing and permits the damping sleeve to protrude through it, and the turning knob non-rotatably slid onto the clamping sleeve is guided in rotary fashion in the protective hood. Between the turning knob and the protective hood, there is a manually detachable detent mechanism whose form-fitting engagement prevents the turning knob from turning back counter to the rotation direction for screwing the clamping sleeve onto the stay rod. This detent mechanism reliably prevents a loosening of the chain tension device through vibrations during operation of the chain saw.

According to an advantageous embodiment of the invention, the stop on the guide for supporting the cam is embodied as a tensioning piece, which at the one end is slid with a pin in form-fitting manner into a bore in the guide and at the other end, rests with a shaped element in a lateral, form-fitting manner in the oblong hole of the guide and preferably rests against the end of the oblong hole remove from the sprocket.

BRIEF DESCRIPTION OF THE DRAWINGS

The invention will be explained in detail in the description below in conjunction with an exemplary embodiment shown in the drawings.

DESCRIPTION OF THE PREFERRED EMBODIMENT

Figure 1:
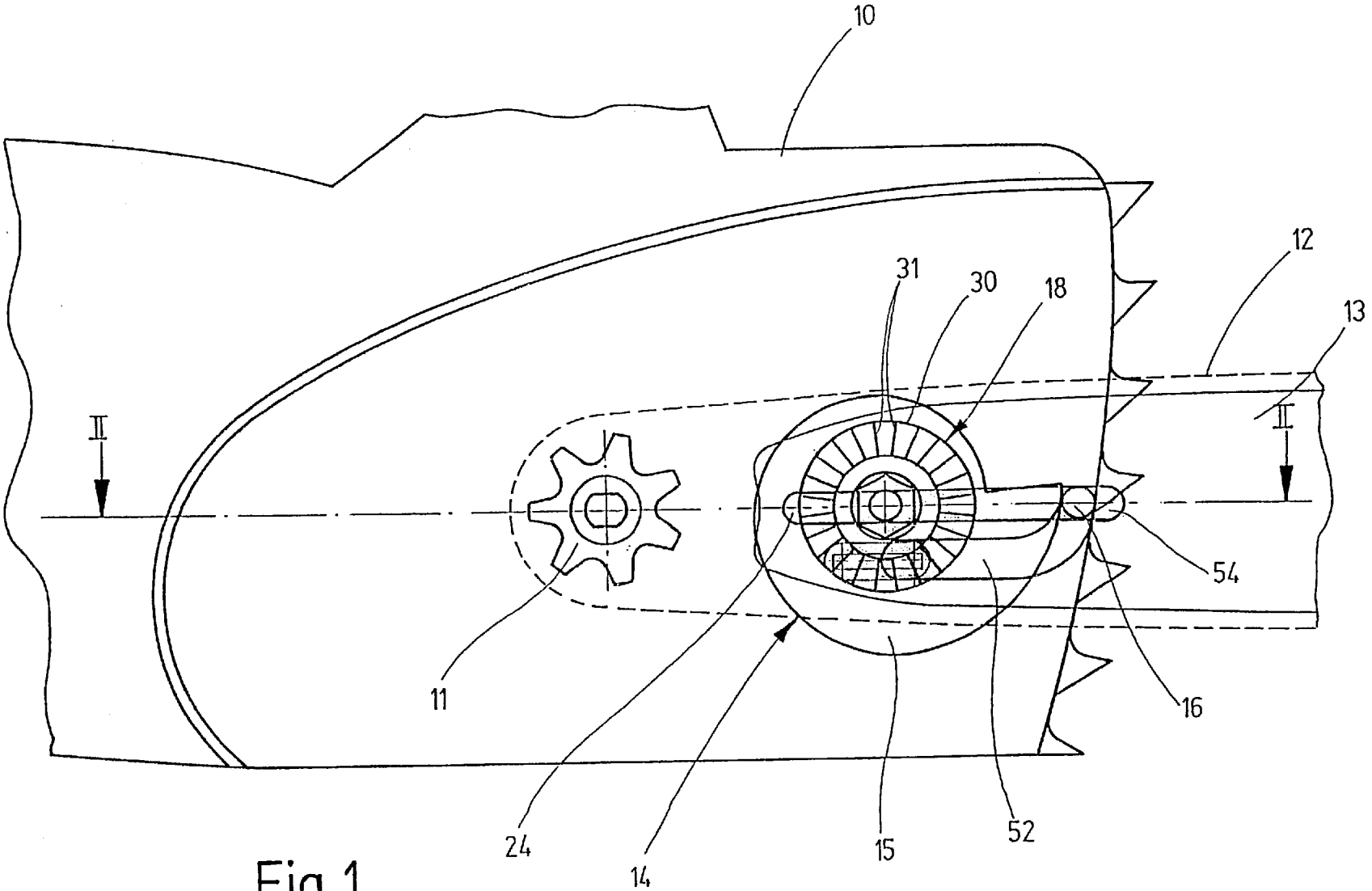
FIG. 1 shows a side-view detail on a chain saw in the vicinity of a chain tension device with the protective hood removed.

FIG. 1 schematically depicts a detail of a chain saw which has a housing 10 in which a sprocket 11 for driving a saw chain 12 is supported in rotary fashion. The sprocket 11 is driven by a transmission, not shown here, of an internal combustion or electric motor and its teeth engage in the saw chain 12. The saw chain 12 is guided along the edge of a guide 13 protruding from the housing 10. In order to produce a saw chain tension, the guide 13 is secured to the housing 10 in a longitudinally movable fashion so that the distance between the guide 13 and sprocket 11 can be changed and as a result, the saw [blade] chain 12 can be stretched more or less tight.

In order to stretch the saw chain 12 fight and to fix the guide 13 in a position on the housing 10 that maintains the set chain tension, a chain tension device 14 is provided which is fastened in a protective hood 40 (FIG. 2) attached to the housing 10. The chain tension device 14 has a cam 15, which is rotatably fixed to the side of the housing and supported against a stop 16 fixed to the [blade] guide 13, and has a rotating member 17 for rotating the cam 15. The rotary connection between the rotating member 17 and the cam 15 Is embodied as an detent overload clutch 18 whose detent overload force is adjusted in accordance with the required chain tension. With this chain tension device 14, by rotating the cam 15 by means of the rotating member 17 and the detent overload clutch 18, the guide 13 is slid forward in a direction that increases the distance from the sprocket 11 and this action stretches the saw chain 12 tight. If the saw chain 12 has now come completely into contact in the guide groove in the longitudinal edge of the guide 13 and is therefore stretched tight, the resistance to the movement of the guide 13 increases. If the rotating member 17 is then turned further in the clockwise direction in FIG. 1, a detent overload of the detent overload clutch 18 occurs as soon as the force for moving the guide 13 exceeds the detent overload force that is set in the detent overload clutch 18. The detent overload clutch 18 therefore assures that after actuation of the chain tension device 14, the saw chain 123 always has the same chain tension which is determined by the detent overload force of the detent overload clutch 18 that is set at the factory. As a result, the chain tension is predetermined independent of the individual feel of the user and is designed for an optimal operation.

Figure 2A:
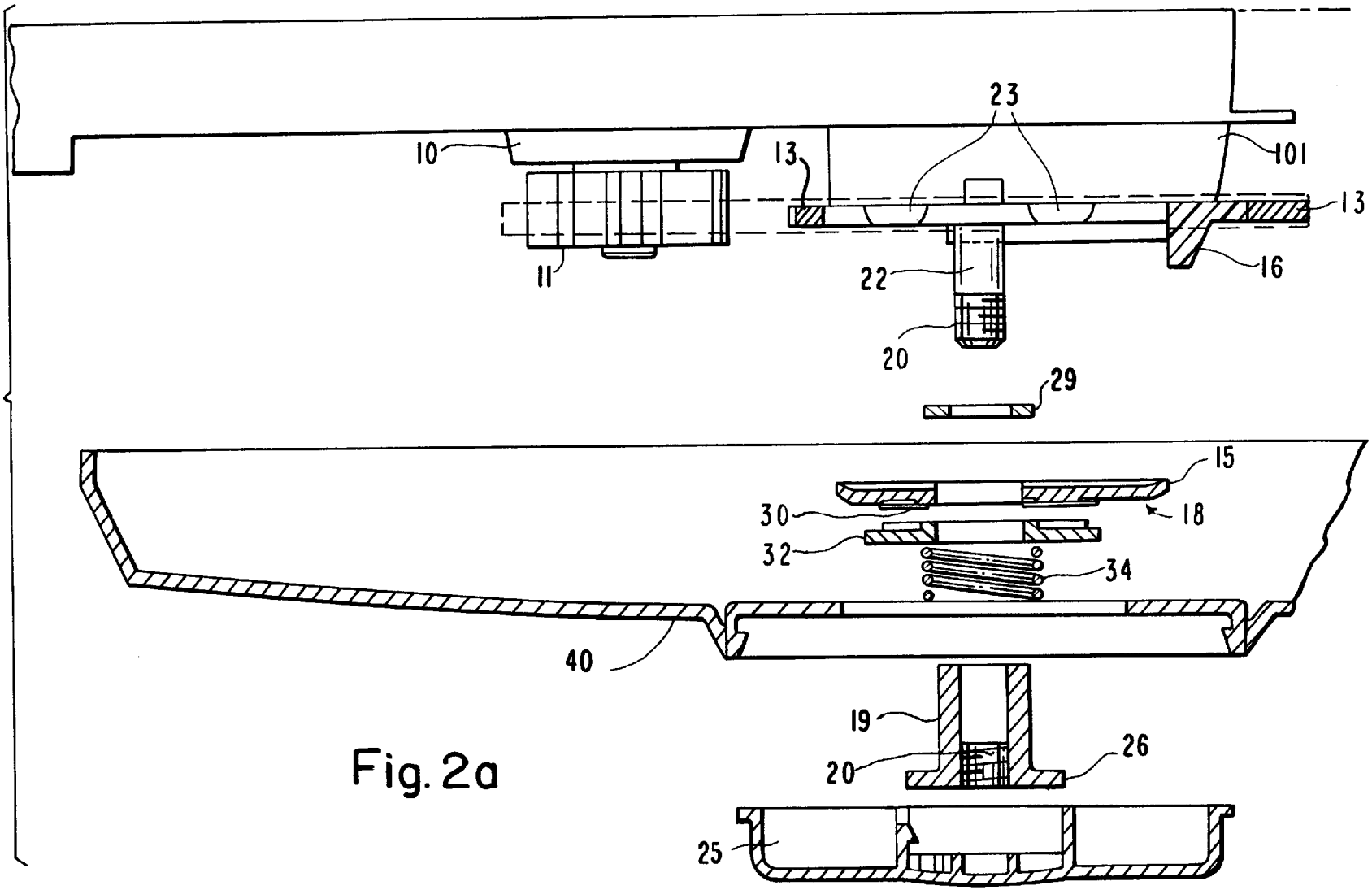
FIG. 2*a* is an exploded view of the section of FIG. 2.
Figure 2:
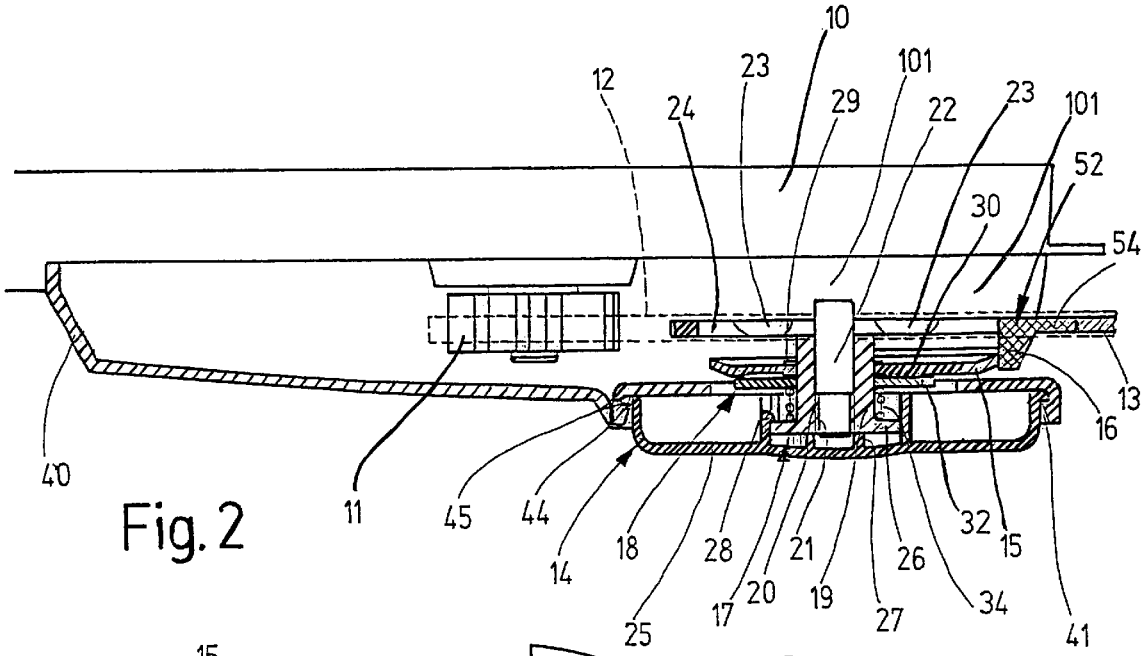
FIG. 2 is a section along the line 11—11 in FIG. 1 through the chain saw with the protective hood in place.
Figure 6:
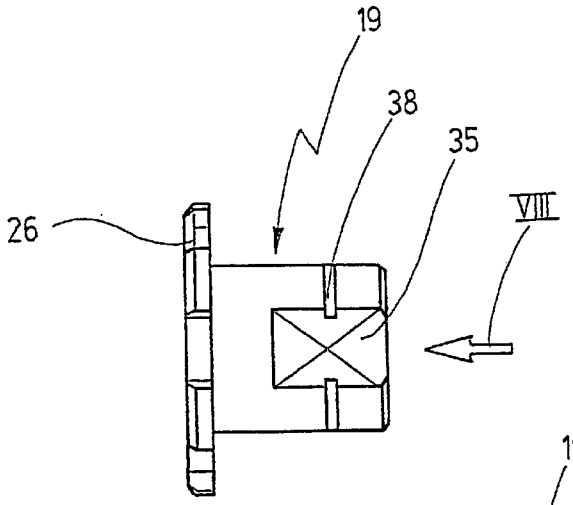
FIG. 6 is a side view of a clamping sleeve of the chain tension device in FIGS. 1 and 2.
Figure 7:
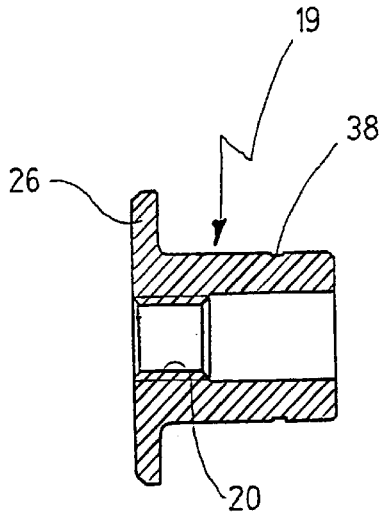
FIG. 7 is a longitudinal section through the clamping sleeve in FIG. 6.
Figure 8:
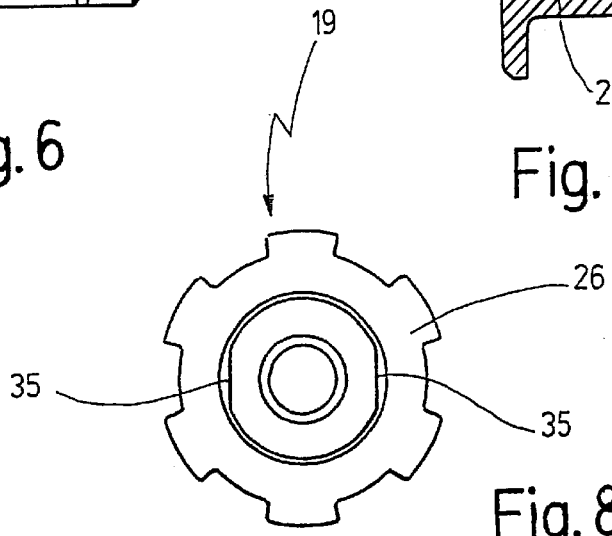
FIG. 8 is a top view of the clamping sleeve in the direction of arrow VIII in FIG. 6.

In the exemplary embodiment of the chain tension device 14 described, the rotating member 17 is embodied as a clamping sleeve 19 (FIGS. 6 to 8) which is screwed with an internally threaded section 20 onto an externally threaded section 21 of a stay rod 22 (FIG. 2). The stay rod 22 is fastened with its end in the housing 10 and protrudes at right angles from a housing projection 101 of the housing 10 to which the guide 13 is secured in a longitudinally movable fashion. In order to guide the guide 13 on the housing projection 101, the latter has two guide bumps 23 which, in order to guide the guide 13, engage in a form-fitting manner with movement play in an oblong hole 24 in the guide 13, which extends in the longitudinal direction of the guide. The stay rod 22 protrudes through the oblong hole 24 in the guide 13, while the clamping sleeve 19 screwed onto the stay rod 22 overlaps the oblong hole 24 and by being screwed onto the stay rod 22, is able to press the guide 13 against the housing projection 101 and to thereby immovably fix the guide 13 to the housing 10. In order to rotate the clamping sleeve 19, a turning knob 25 is non-rotatably slid onto its free end. For this purpose, on its end remote from the guide 3, the clamping sleeve 19 has a radially protruding flange 26 which is contained in a form-fitting manner in the turning knob 25 and is supported with its top against a collar 27 formed inside the turning knob 25 and snap hooks 28 that are of one piece with the turning knob 25 engage behind the bottom of the flange 25 (FIG. 2). The cam 15 is supported in rotatary fashion on the clamping sleeve 19 and is prevented from moving axially toward the guide 13 by means of a securing ring 29 affixed in the clamping sleeve 19.

Figure 3:
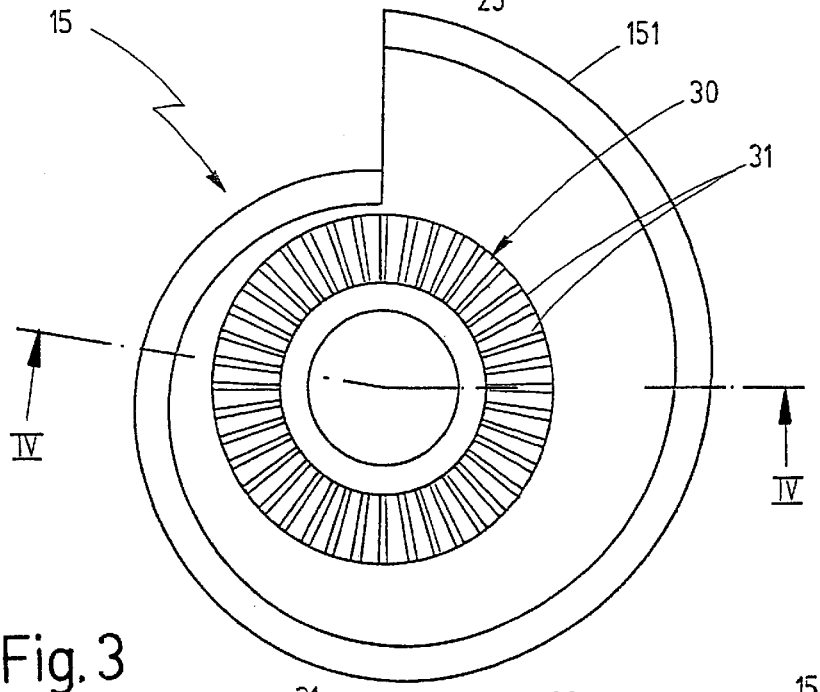
FIG. 3 is a top view of a cam with the first clutch disk of the chain tension device in FIGS. 1 and 2.
Figure 4:
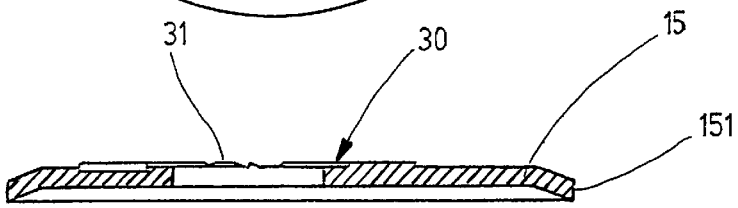
FIG. 4 is a section along the line IV—IV in FIG. 3.
Figure 5:
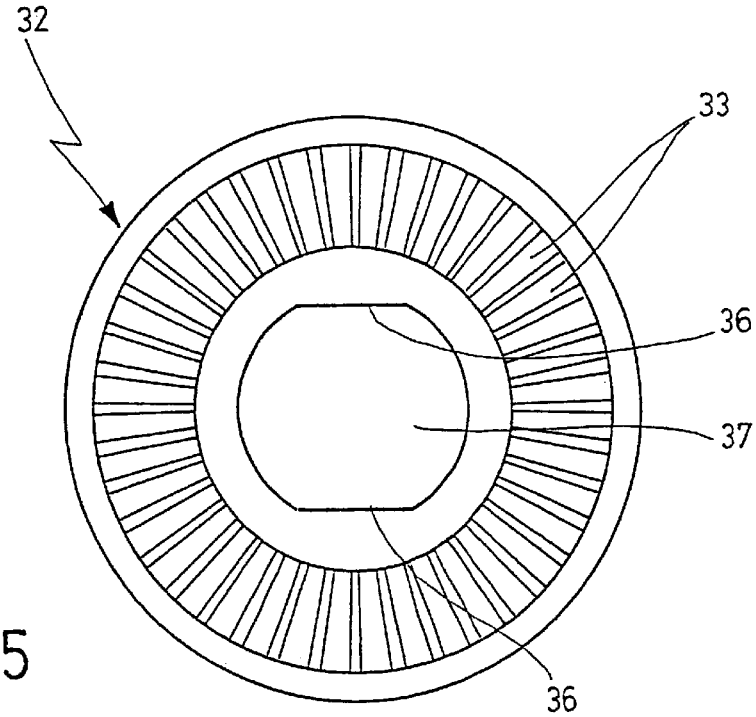
FIG. 5 is a top view of a second clutch disk of the chain tension device in FIGS. 1 and 2.

The detent overload clutch 18 disposed between the cam 15 and clamping sleeve 19 has a first clutch disk 30 non-rotatably connected to the cam 15 with detent elements 31 disposed equidistantly over the disk circumference (FIG. 3), a second clutch disk 32 non-rotatably fixed to the clamping sleeve 19 provided with detent elements 33 disposed equidistantly over the disk circumference (FIG. 5), and a clutch spring 33. The two clutch disks 30, 32 rest with their detent elements 31, 33 against each other, wherein the detent elements 31 of the clutch disk 30 are formed onto the cam 15 and are of one piece with it, and the detent elements 31, 33 are pressed against each other in the axial direction by the clutch spring 34. As FIG. 2 shows, the clutch spring 34 is embodied as a helical compression spring, which is supported at one end against the back side of the second clutch disk 32 remote from the cam 15 and is supported at the other end against the underside of the flange 26 on the clamping sleeve 19, oriented toward this second clutch disk 32. The detent overload force of the detent overload clutch 18 is set through greater or lesser prestressing of the clutch spring 34. As can be inferred from FIGS. 2, 5, 6, and 7, and rotationally fixed connection between the second clutch disk 32 and the clamping sleeve 19 is achieved by means of form fitting engagement by virtue of the fact that a flattening 35 is respectively provided on diametrically opposite sides of the clamping sleeve 19, onto which the second clutch disk 32 is slid with corresponding, parallel flat edges 36 of a central slide-mount opening 37. The annular groove 38 in FIGS. 6 and 7, which is disposed on the circumference of the clamping sleeve 19, serves to contain the previously mentioned securing ring 29 for axially fixing the cam 15.

As can be seen in FIG. 2, the turning knob 25, which is slid in a form-fitting manner onto the flange 26 of the clamping sleeve 19 and engages the flanges 26 in detent fashion, is guided in rotary fashion in the protective hood 40 that covers the sprocket 11 and the chain tension device 14, to which end the protective hood 40 has a circular, cuplike recess 41 coaxial to the clamping sleeve 19, and the turning knob 25 is inserted into this recess 41. The turning knob 25 is depicted by means of a grip strip 43 embodied on it in a top view in FIG. 9, in a partially sectional side 3 view in FIG. 10, and in a longitudinal section in FIG. 2. It has a flat knob plate 42, with the diametrically extending grip strip 43 protruding at right angles from it, and a continuous, radially protruding annular rib 44 on the knob plates 42. The turning knob 25 rests with its knob plate 42 against the cup bottom of the recess 41 and leaving a rotary play, engages with its annular rib 44 behind a number of detent hooks 45 disposed in the annular wall of the recess 41 in the protective hood 40.

Figure 9:
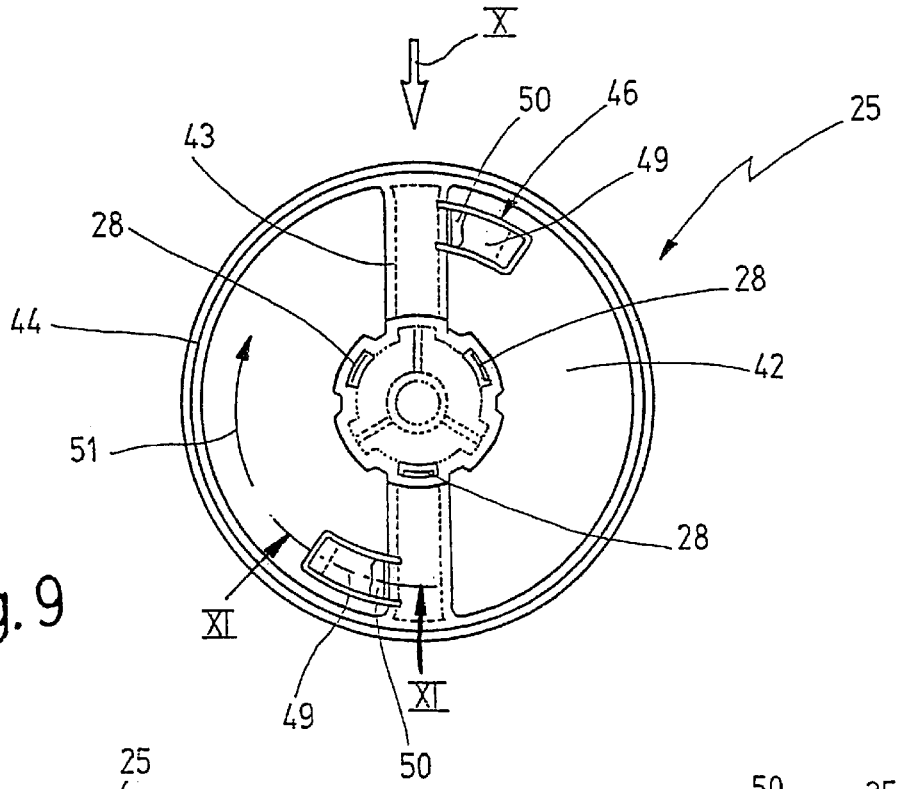
FIG. 9 is a top view of a turning knob of the chain tension device in FIGS. 1 and 2.
Figure 10:
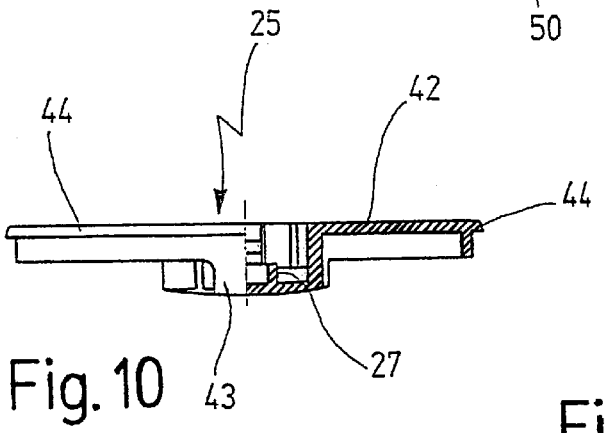
FIG. 10 is a partially sectional view of the turning knob in the direction of arrow X in FIG. 9.
Figure 11:
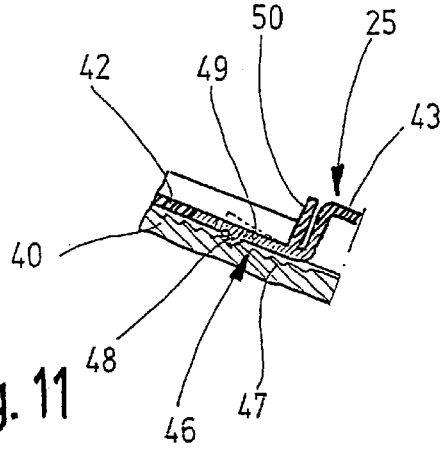
FIG. 11 is a section along the line XI—XI in FIG. 9.

As shown in FIGS. 9 and 11, a manually detachable detent mechanism 46 is provided between the turning knob 25—and its knob plate 42 in fact—and the protective hood 40—and the cup bottom of the recess 41 in fact—which prevents the turning knob 25 from turning back counter to the rotation direction for screwing the clamping sleeve 19 onto the stay rod 22, i.e. a counterclockwise rotation in FIG.

9. This detent mechanism 46 prevents the clamp connection between the clamping sleeve 19, the guide 13, and the housing projection 101 from loosening during operation of the chain saw and consequently prevents the chain tension from changing. The detent mechanism 46 has an annular saw-toothed strip 47 (FIG. 11) formed onto the cup bottom of the recess 41, coaxial to the clamping sleeve 19, as well as two diametrically disposed detent projections 48 elastically protruding from the underside of the turning knob 25 oriented toward the protective hood 40, which engage in a frictional and form-fitting manner in the saw-toothed strip 47. Each detent projection 48 is disposed on the underside of a flexible tongue 49 that is cut out from the knob plate 42 on three sides. At the base of the flexible tongue 49, a tab 50 that is of one piece with the flexible tongue 49 protrudes at right angles and extends parallel to the grip strip 43 spaced slightly apart from it. If the tabs 50 are pressed toward the grip strip 43 with the thumb and finger, then the flexible tongues 49 lift up slightly, as shown with dashed lines in FIG. 11, and the detent projections 48 disengage from the saw-toothed grip 47 as a result of which, the detent mechanism 46 is released and the turning knob 25 can then be also turned in the opposite direction, i.e. counter to arrow 51 in FIG. 9, in order to release the clamped connection between the clamping sleeve 19 and the blade 13.

Figure 12:
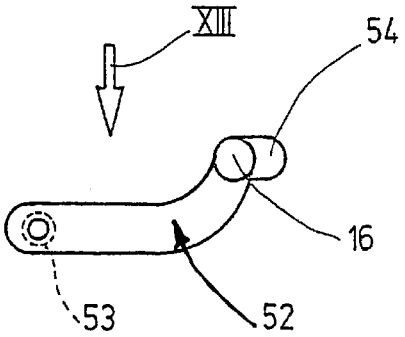
FIG. 12 is a top view of a tensioning piece of the chain tension device in FIGS. 1 and 2.
Figure 13:
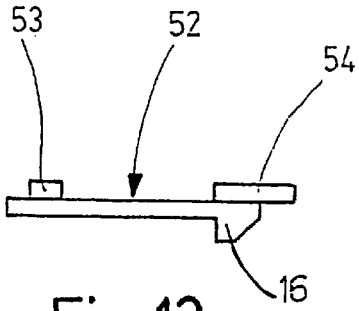
FIG. 13 is a side view of the tensioning spring in the direction of arrow XIII of FIG. 12.

FIGS. 12 and 13 show another exemplary embodiment for the stop 16 on the guide 13, which stop cooperates with the cam 15. For a simplified manufacture of the blade 13, the stop 16 is embodied on a separate tensioning piece 52 manufactured using zinc diecasting, which is attached to the guide 13 during assembly. To this end, the tensioning piece 52, which is shown in a top view in FIG. 12 and in a side view in FIG. 13, has a pin 53 protruding at right angles from it and a shaped element 54 protruding from the same side. During assembly of the chain saw, the tensioning piece 52 is inserted in a form-fitting manner into a corresponding bore in the guide 13 so that the shaped element 54 rests in a lateral, form fitting manner in the oblong hole 24 of the blade 13 and preferably rests against the end of the oblong hole 24 remote from the sprocket 11. The stop 16 protrudes from the top of the tensioning piece 52 remote from the pin 53 and the shaped element 54 and after assembly, is flush with the cam.

The chain tension device 14 described above functions as follows:

In order to stretch the saw chain tight by rotating the turning knob 25 in the arrow direction 51 in FIG. 9, the clamping sleeve 19 is rotated and thus the cam 15 is rotated by means of the detent overload clutch 18. As a result of this rotating movement of the cam 15 clockwise in FIGS. 2 and 9, the outer curved track 151 of the cam 15 (FIG. 3) comes into contact with the stop 16 on the tensioning piece 52 of the blade 13. Because of the outer curved track 151 of the cam 15, the guide 13 is then slid forward away from the sprocket 11. As a result, the saw chain 12, which is guided in the groove of the guide 13, is stretched increasingly tight. It the saw chain 12 has come into complete contact in the groove of the guide 13 and is thereby stretched tight, the resistance at the tensioning piece 52 to the movement of the guide 13 increases. If the turning knob 25 is then rotated further in the clockwise direction and the resistance of the tensioning piece 52 is then greater than the detent elements 31 and 33 on the clutch disk 30 and 32 disengage and the detent overload clutch 18 experiences a detent overload. A further rotation of the turning knob 25 causes the clamping sleeve 19, which is being screwed further onto the externally threaded section 21 of the stay rod 22, to the clamp guide 13 to the housing projection 101 of the housing 10. Because of the presence of the detent mechanism 46 between the turning knob 25 and the protective hood 40, tightening the clamping sleeve 19 causes a form-fitting connection to be produced so that an automatic loosening of the turning knob 25 and thereby a loosening of the chain tension cannot occur during operation of the chain saw.

What is claimed is:

1. A chain saw having a housing (10) having a sprocket (11) supported in the housing (10) for the motor-powered driving of a saw chain (12), having a guide (13) protruding from the housing (10), which continuously guides the saw chain (12) engaging the sprocket (11) along its blade edge and which, in order to stretch the saw chain (12) tight, is secured to the housing (10) so that it can be moved longitudinally in a direction that increases the distance to the sprocket (11), and having a chain tension device (14) that has a cam (15), which is supported against a stop (16) fixed to the guide (13) and produces a longitudinal movement of the guide (13), and has a rotating member (17) for rotating the cam (15), characterized in that the rotary connection between the rotating member (17) and cam (15) is embodied as a detent overload clutch (18), whose detent overload force is set in accordance with the required chain tension of the saw chain (12).

2. The chain saw according to claim 1, characterized in that the cam (15) is supported on the rotating member (17) in a rotating, but axially fixed manner and that the detent overload clutch (18) has a first clutch disk (30) provided with detent elements (31) and non-rotatably fixed to the cam (15) and a second clutch disk (32) provided with detent elements (33) and non-rotatably fixed to-the rotating member (17) as well as a prestressed clutch spring (34) which presses the two clutch disks (30, 32) axially against each other, with their detent elements (31, 33) resting against one another.

3. The chain saw according to claim 2, characterized in that the first clutch disk (30) is embodied as being of one piece with the cam (15).

4. The chain saw according to claim 2 or 3, characterized in that the rotating member (17) is embodied as a clamping sleeve (19) which is screwed with an internally threaded section (20) onto an externally threaded section (21) of a stay rod (22) secured in the housing (10) and that in order to actuate the clamping sleeve (19), a turning knob (25) is slid onto this clamping sleeve in a non-rotating fashion.

5. The chain saw according to claim 4, characterized in that the stay rod (22) protrudes through an oblong hole (24) embodied in the guide (13) and that the clamping sleeve (19) overlaps the oblong hole (24) and by being screwed onto the stay rod (22), can be pressed against the guide (13) in order to fix the guide (13) to the housing (10).

6. The chain saw according to claim 5, characterized in that the sprocket (11) and the chain tension device (14) are covered by a protective hood (40) which is attached to the housing (10) and permits the clamping sleeve (19) to protrude through it, that the turning knob (25) non-rotatably slid onto the clamping sleeve (19) is guided in rotary fashion in the protective hood (40), and that between the turning knob (25) and the protective hood (40), a manually detachable detent mechanism (46) is provided which, through form-fitting engagement, prevents the turning knob (25) from turning back counter to the rotation direction for screwing the clamping sleeve (19) onto the stay rod (22).

7. The chain saw according to claim 6, characterized in that the detent mechanism (46) has an annular saw-toothed strip (47) disposed on the protective hood (40) coaxial to the clamping sleeve (19) and at least one detent projection (48) elastically protruding from the underside of the turning knob (25) oriented toward the protective hood (40) and this detent projection (48) engages in a frictional and form-fitting manner in the saw-toothed strip (47).

8. The chain saw according to claim 6 or 7, characterized in that the turning knob (25) has a flat knob plate (42), with a diametrically extending grip strip (43) protruding at right angles from it, that the knob plate (42) rests against the bottom of a circular, cup-like recess (41) in the protective hood (40) and has a continuous, radially protruding annular rib (44) which a number of detent hooks (45) disposed in the annular wall of the recess (40) engage behind with rotary play.

9. The chain saw according to claim 4, characterized in that on its end remote from the guide (13), the clamping sleeve (19) has a radially protruding flange (26) which is contained in a form-fitting manner in the turning knob (25) and that the clutch spring (34) is a helical compression spring that is slid onto the clamping sleeve (19) and is supported between the flange (26) and the second clutch disk (32).

10. The chain saw according to claim 9, characterized in that the flange (26) is supported with its top against a collar (27) formed inside the turning knob (25) and snap hooks (28) that are of one piece with the turning knob (25) engage behind the bottom of the flange (26).

* * * * *